US005946022A

United States Patent [19]

Kamimura

[11] Patent Number: 5,946,022

[45] Date of Patent: Aug. 31, 1999

[54] LED HEAD

[75] Inventor: Katsuya Kamimura, Tokyo, Japan

[73] Assignee: Oki Data Corporation, Tokyo, Japan

[21] Appl. No.: 09/033,914

[22] Filed: Mar. 3, 1998

[30] Foreign Application Priority Data

Mar. 6, 1997 [JP] Japan ..... 9-051381

[51] Int. Cl.[6] ..... B41J 2/45

[52] U.S. Cl. ..... 347/238; 347/237; 347/242

[58] Field of Search ..... 347/237, 238, 347/242; 257/88

[56] References Cited

U.S. PATENT DOCUMENTS 5,307,089 4/1994 Takasu et al. ..... 347/238
5,691,760 11/1997 Hosier et al. ..... 347/238
5,828,400 10/1998 Fleming ..... 347/238

*Primary Examiner*—N. Le
*Assistant Examiner*—Lamson D. Nguyen
*Attorney, Agent, or Firm*—Rabin & Champagne, P.C.

[57] ABSTRACT

An LED head includes a circuit board and a plurality of LED arrays aligned on the circuit board in a longitudinal direction of the circuit board. Each of the plurality of LED arrays includes a row of a plurality of first LEDs aligned in the longitudinal direction between a second LED and a third LED. The second and third LEDs are at the end of the row. The first LEDs have a width W1 in the longitudinal direction and the second LED and the third LED have a width W2 in the longitudinal direction. The width W2 is smaller than a width W1. The first, second, and third LEDs have the same dimension D in a direction perpendicular to the longitudinal direction. The first, second, and, third LEDs are aligned at predetermined intervals P1 and the plurality of LED arrays are aligned such that the first, second, and third LEDs are aligned in the predetermined intervals P1.

12 Claims, 9 Drawing Sheets

LED HEAD

BACKGROUND OF THE INVENTION

1. Field of the Invention

The present invention relates to LED heads.

2. Description of Related Art

FIG. 6 illustrates a general construction of a conventional LED type electrophotographic printer. Referring to FIG. 6, a photosensitive drum 11 rotates in a direction shown by arrow A. Disposed around the photosensitive drum 11 are a charging roller 12, an LED head 13, a developing roller 14, and a transfer roller 15. The charging roller 12 uniformly charges the surface of the photosensitive drum 11. The LED head 13 illuminates the charged surface of the photosensitive drum 11 to form an electrostatic latent image in the surface. The developing roller 14 applies toner 17 to the surface of the photosensitive drum 11 to develop the electrostatic latent image into a toner image. The transfer roller 15 transfers the toner image onto the print medium 16 passing between the photosensitive drum and the transfer roller 15.

When the LED head 13 illuminates the charged surface of the photosensitive drum 11, the light impinges the charged surface of the drum, so that, the charges in illuminated areas on the photosensitive drum 11 are neutralized. The developing roller 14 is negatively charged and applies negatively charged toner 17 to the neutralized areas on the photosensitive drum 11.

FIG. 7 illustrates a general construction of a conventional LED head 13. FIG. 8 illustrates the electrical wiring between an LED array 22 and an LED driver 26.

Referring to FIGS. 7 and 8, a plurality of LED arrays 22 are arranged side by side on an LED circuit board 21. The LED array 22 includes a plurality of LEDs 25 aligned in line on a p-type semiconductor substrate 29. The LEDs 25 are driven by the LED driver 26. Each LED array 22 is electrically connected with a corresponding LED driver 26 via wires 28 as shown in FIG. 8. A lens 23 is placed in the path of the light emitted from the LED array 22 so as to form an image of each LED on the surface of the photosensitive drum 11. A holder 24 supports the LED circuit board 21 and the lens 23 in position.

FIG. 9 illustrates a conventional LED array. The LED 25 includes a square light-emitting element 27 and the electrode 30 connected to the light emitting element 27. The light emitting element 27 is an n-type semiconductor region formed on a p-type semiconductor substrate 29 by diffusing an impurity. Each LED array 22 has 64 or 128 light emitting elements 27 at intervals of 300 to 600 dpi (dot per inch).

When the LED driver 26 drives the LED 25, the LED 25 emits light which is focused into a spot by the lens 23.

However, when a printing is performed at a higher resolution of about 1200 dpi, the aforementioned conventional LED head 13 cannot provide the same print quality as for a resolution of 300 to 600 dpi.

FIG. 10 illustrates a conventional LED array 22 used in a conventional LED type electrophotographic printer. Referring to FIG. 10, the light emitting elements 27 are aligned at intervals of q1, e.g., 21 microns corresponding to the resolution of the printer. The light emitting elements 27 have a width W1 of about 10 microns and are spaced apart by a distance u1 of about 11 microns. Too large a width W1 reduces separation of adjacent dots in the print and too narrow a width W1 results in poor connectivity of adjacent dots in the print. The optimum value of the width W1 is empirically determined.

If the LED arrays 22 are mounted on the LED circuit board 21 in such a way that the center-to-center distance between the last light emitting element 27*b* of one LED array 22 and the first light emitting element 27*a* of the next LED array 22 is q2, different from the interval q1 at which other light emitting elements are aligned on each LED array, all of the printed dots are not at the same intervals. Therefore, the LED arrays 22 are mounted on the LED circuit board 21 with the distance q2 adjusted equal to the interval q1.

In order that the LED arrays 22 are mounted on the LED circuit board 21 without touching each other, a maximum distance e1 from the endmost elements (elements 27*a* and 27*b*) to the edge of the LED array 22 must be 5 microns.

The LED array 22 is fabricated in semiconductor processes. Thus, the interval q1 depends on the accuracy of the mask, not shown, and may be fabricated with an accuracy of 1 micron. In contrast, the semiconductor wafer is mechanically diced into individual LED array 22. Thus, the dicing error ranges ±4 microns, i.e., 8 microns maximum.

Therefore, for example, if a nominal distance $e_{nom}$ from the last, light-emitting element 27*b* to the longitudinal edge of the LED array 22 is 5 microns, the distance $e_{min}$ becomes as short as 1 micron or less. With such a short distance $e_{min}$, light emitted from the last light emitting element 27*b* of the LED array 22 leaks from the end of the LED arrays in the direction parallel to the surface of the LED array 22. As a result, the effective size of the last light emitting element 27*b* is larger than its physical size, causing larger dots than other spots. This impairs the print quality.

SUMMARY OF THE INVENTION

An object of the present invention is to solve the aforementioned drawbacks of the conventional LED head, and provide an LED head where the print quality is not impaired when high resolution printing is performed.

An LED head comprises a circuit board and a plurality of LED arrays aligned in a longitudinal direction on the circuit board. Each of the plurality of LEDs includes a row of a plurality of first LEDs, a second LED, and a third LED aligned in the longitudinal direction. The second and third LEDs are at the beginning and end of the row, respectively. The second LED and the third LED have a width W2 in the longitudinal direction and the first LEDs have a width W1. The width W2 is smaller than the width W1. The first, second, and third LEDs have a same dimension in a direction perpendicular to the longitudinal.

The first LEDs, the second LED, and the third LED are aligned at predetermined intervals P1 and the plurality of LED arrays are aligned such that the first, second, and third LEDs are aligned at the predetermined intervals P1 in the longitudinal direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

Embodiment

Figure 1:
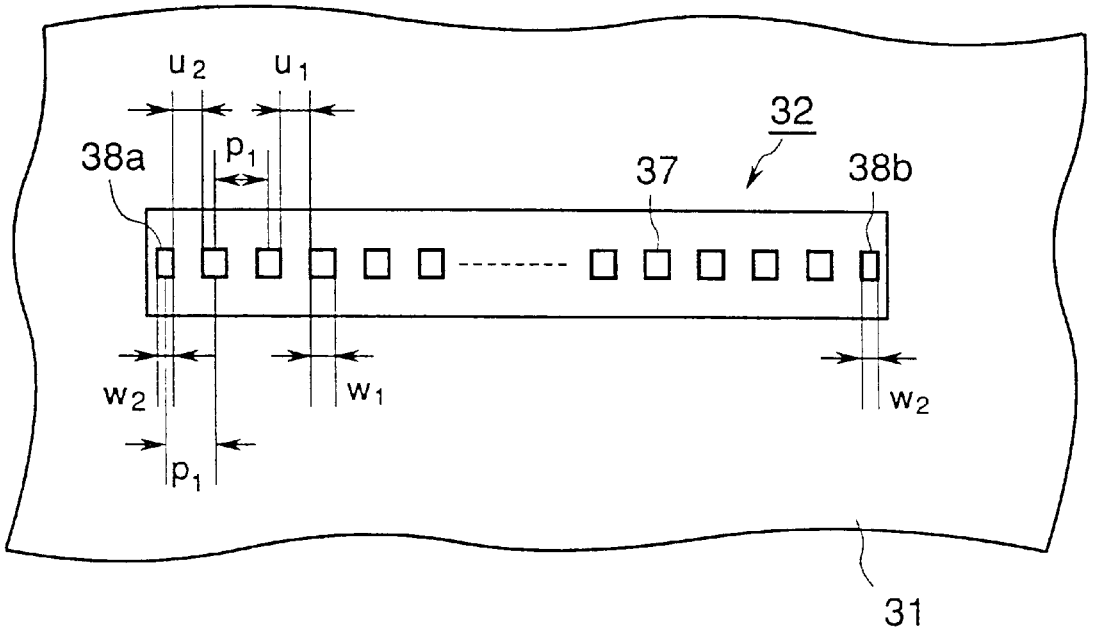
FIG. 1 is a top view of an LED of the invention, showing a general construction thereof.

FIG. 1 is a top view, showing a general construction of an LED array of the invention mounted on an LED circuit board 31. LEDs 37 are aligned at predetermined intervals of P1=21 m in a first, i.e. longitudinal direction of the LED array 32. The LEDs 37 have a width W1. First and last LEDs 38*a* and 38*b* have a smaller width W2 than the LEDs 37.

Figure 2A:
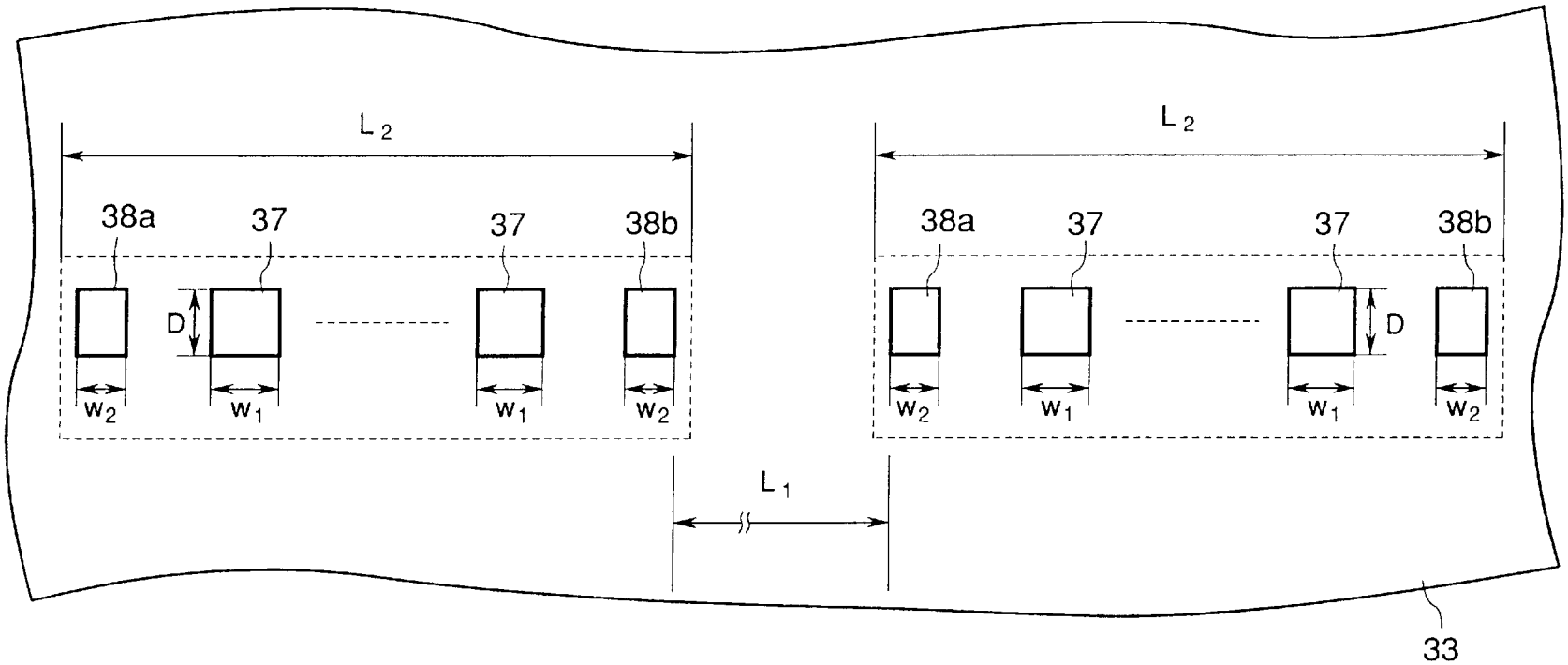
FIG. 2A illustrates the two LED arrays of the invention when mounted side by side on a circuit board.

FIG. 2A illustrates a part of a semiconductor wafer on which a plurality of LED arrays are fabricated.

Each LED array includes a plurality of the LEDs 37, LED 38*a,* and LED 38*b* aligned in a longitudinal direction. The LEDs 37 are between the LED 38*a* and the LED 38*b*. The LED arrays are spaced apart by a predetermined distance. A distance L2 of about 5 mm is a total length of the LED array. Adjacent LED arrays are spaced apart by a distance L1 of about 1–2 mm. The semiconductor wafer is diced into individual LED arrays.

Figure 2B:
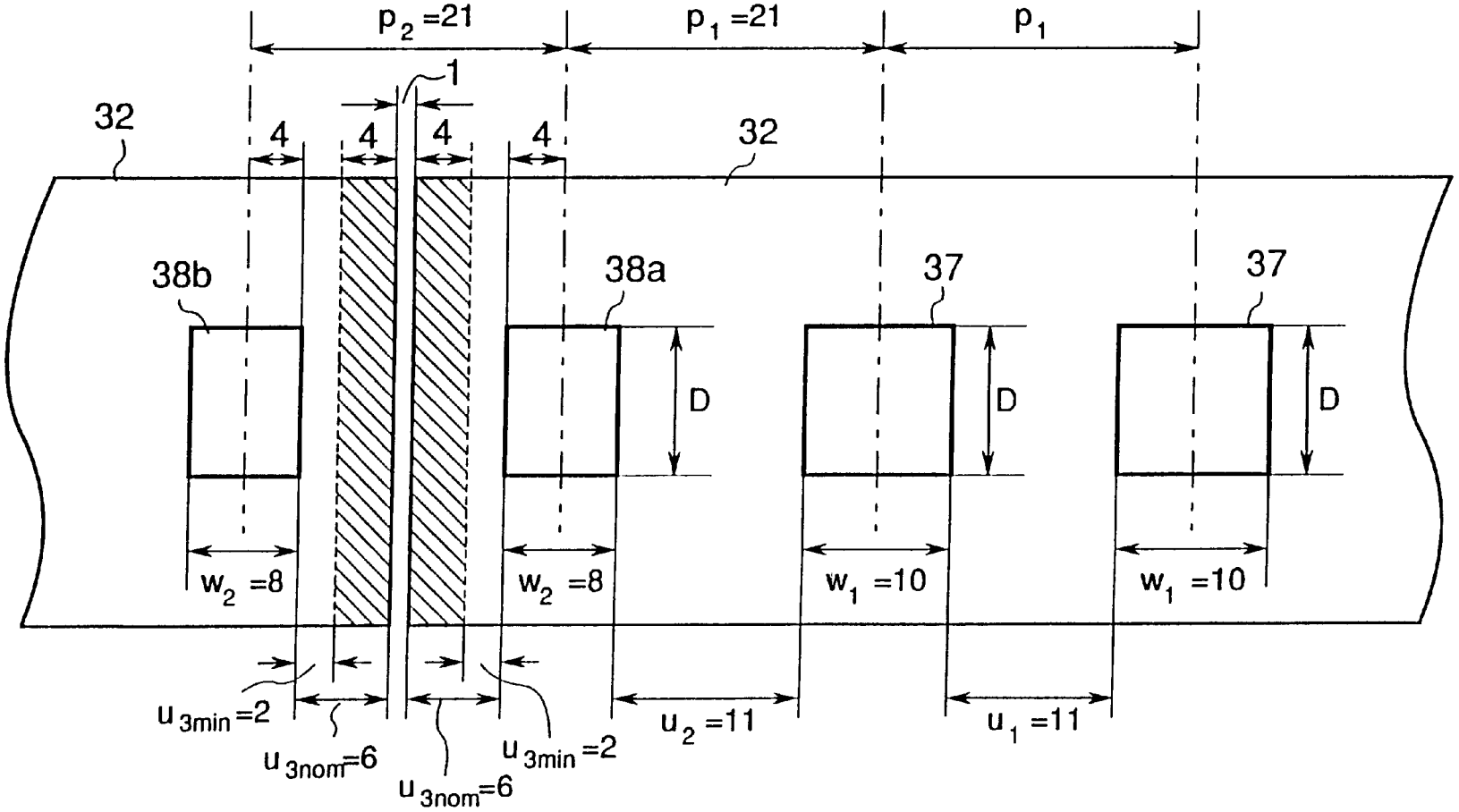
FIG. 2B illustrates a part of a semiconductor wafer on which a plurality of LED arrays are fabricated.

FIG. 2B illustrates the two LED arrays of the invention when mounted side by side on the circuit board 31.

Referring to FIG. 2B, the LED array 32 includes the LED 38*b,* LED 38*a,* and LEDs 37. The LED 38*b* and its adjacent LED 37 are spaced apart by a distance u2 of about 12 microns. The LED 38*a* and its adjacent LED 37 are also spaced apart by the distance u2 of about 12 microns. The LEDs 38*a,* 38*b,* and 37 have the same dimension D in a direction perpendicular to the longitudinal direction of the LED array 32. Therefore, the LEDs 38*a* and 38*b* have a smaller light-emitting area than the LEDs 37. The LEDs 37 are aligned at intervals of u1=11 microns. The LED arrays 32 are aligned in line such that the LEDs 38*b* and LEDs 38*a* of adjacent LED arrays 32 are spaced apart by a center-to-center distance P2. The LED 37 has a width W1 of about 10 microns and the LEDs 38*a* and 38*b* have a width W2 of about 8 microns. Too large a width W1 results in poor separation of adjacent printed dots and too small a width W1 impairs connectivity of adjacent printed dots. The width W1 is empirically determined for an optimum value.

In order to provide the same, uniform distance between the dots printed on a print medium, the LED arrays 32 should be mounted on the LED printed circuit board such that the center-to-center distance P2 is the same as the interval P1 at which the LEDs 37 are aligned on each LED array.

If the distance P2 is set equal to the interval P1, the distance between the LED 38*b* of one LED array and the LED 38*a* of adjacent LED array is about 13 microns. Dicing operation is a mechanical cutting operation of the wafer and is therefore not so accurate as mask alignment during semiconductor manufacturing processes. Typically, dicing error ranges ±4 microns, i.e., 8 microns maximum.

It is to be noted that the LED 38*b* and LED 38*a* has a width W2=8 microns, smaller than the width W1=10 m of the LEDs 37. Thus, if a nominal value of the distance u3 between and the LED 38*b* or the LED 38*a* and the longitudinal end of the LED array 32 is designed to be 6 microns, then the value of the distance u3min=2 can be ensured after dicing. In other words, the distance u3 ranges from u3min=2 to u3nom=6 microns if the dicing error is between +0 and −4 microns as depicted by hatched areas. The distance u3 ranges from u3nom=6 to u3max=6+4=10 microns if the dicing error is −0 and +4 microns, but this case is not depicted in FIG. 2B. Consequently, the distance u3 ranges from 2 to 10 microns if the dicing error is in the range of −4 to +4 microns.

Due to the variations of the distance u3, the LED arrays 32 may not be mounted on the circuit board in such a way that the center-to-center distance P2 between the LED 38*b* of one LED array 32 and the LED 38*a* of the next LED array 32 is equal to the interval P1. For example, if one of the adjacent LED arrays 32 has a distance u3=8 microns and the other has a distance u3=10, the two adjacent LED arrays cannot be mounted such that P1=P2=21 microns. Such LED arrays are simply rejected.

Making the width W2=8 microns of the LEDs 38*a* and 38*b* shorter than the width W1=10 m of the LEDs 37 provides a minimum value (2 m) of the distance u3 which prevents the emitted light from leaking through the edge of the LED array 32 in the longitudinal direction of the LED array 32. This ensures that the light emitted from the LEDs 38*a* and 38*b* travels in the direction normal to the surface of the LED array 32.

However, the LEDs 38*a* and 38*b* having the width W2 smaller than the width W1 of the LEDs 37 emit a smaller amount of light than the LEDs 37, forming a smaller printed dot than the LEDs 37. Thus, it is necessary that the LED 38*a* and 38*b* are driven to emit the same amount of light as the LEDs 37.

Figure 3:
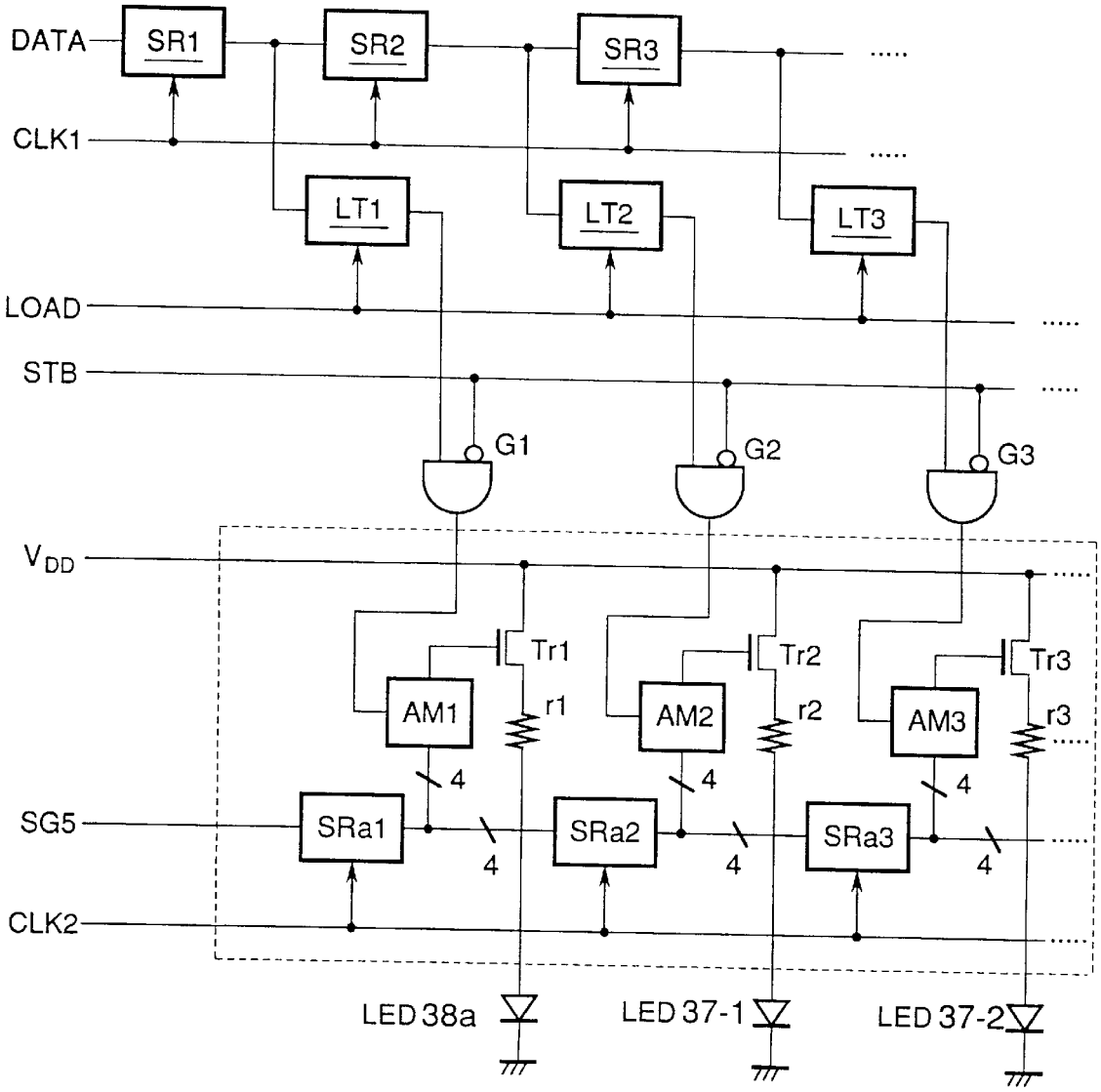
FIG. 3 is a block diagram illustrating an LED driver of the invention.
Figure 4:
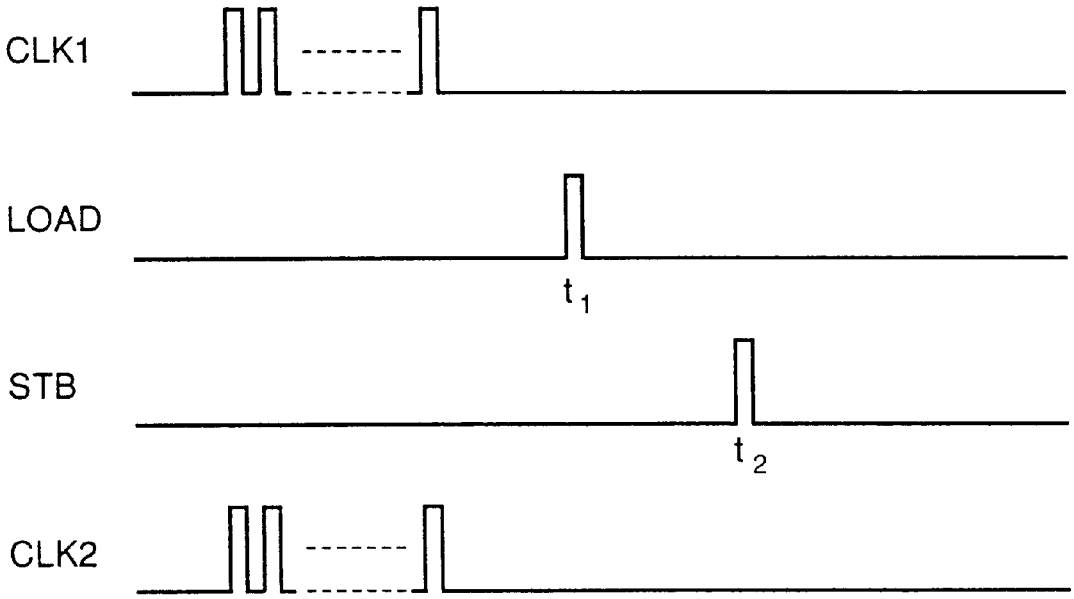
FIG. 4 is a timing chart of the head driver.

FIG. 3 is a block diagram, showing a relevant portion of an LED head driver of the invention which drives LEDs in such a way that all of the LEDs emit substantially the same amount of light. FIG. 4 is a timing diagram of signals CLK1, CLK2, LOAD, and STB shown in FIG. 3.

The operation of the LED head driver will be described with reference to FIGS. 3 and 4.

Referring to FIG. 3, bits of print data DATA are shifted through shift registers SR1, SR2, SR3, . . . on each clock CLK1. The latches T1, T2, T3, . . . hold the output bits of the shift registers SR1, SR2, SR3, . . . , respectively. Each of LED 37-1, LED 37-2, . . . , and LED 38*a* on the LED array 32 is supplied with a corresponding drive current. A non-volatile memory, not shown, stores 4-bit current data. The 4-bit current data indicates a current value that should be run through a corresponding LED for a predetermined amount of light, and is output as a current-value signal SG5 from the non-volatile memory. Each value of the current data is determined by measuring an actual current through a corresponding LED that generates a predetermined amount of light. The LEDs 37, LED 38*a*, LED 38*b* are supplied with different currents so that differences among amounts of light emitted from the LEDs 37, LED 38*a*, and LED 38*b* are reduced. The current values are converted into 4-bit data which allows grouping of the measured currents in 16 different levels. The number of bits may be increased to group currents flowing through the LEDs in smaller increments, thereby reducing variations in amount of light emitted from the LEDs 38*a* and 37-1, 37-2, 37-3, . . . .

The current-value signals SG5 received from the non-volatile memory are shifted through the shift registers SR1, SR2, SR3, . . . on each clock CLK2. Bits of the print data DATA are passed shifted through the shift registers SR1, SR2, SR3, . . . on each clock CLK1, thereby storing bits for one line to be printed.

Then, the latches T1, T2, T3, . . . hold the output of the shift registers SR1, SR2, SR3, . . . , respectively, on the latch signal LOAD at time t1 (FIG. 4). The contents of the latches T1, T2, T3, . . . are then input to gates G1, G2, G3, The amplifiers AM1, AM2, AM3, . . . drive transistors Tr1, Tr2, Tr3, . . . in accordance with the current-value signals SG5 stored in the corresponding shift registers SRa1, SRa2, SRa3, . . . so that the transistors Tr1, Tr2, Tr3, . . . supply corresponding currents to the LEDs 38*a* and 37-1, 37-2, 37-3, . . . . The current flowing through the LEDs 38*a* is larger than those flowing through the LEDs 37-1, 37-2, 37-3, . . . .

After all of the shift registers SRa1, SRa2, SRa3, . . . have held the corresponding current-value signals SG5, the gates G1, G2, G3, . . . are simultaneously opened by a strobe signal STB at time t2 (FIG. 4) to output, corresponding logical levels of the latches T1, T2, T3, . . . to later described amplifiers AM1, AM2, AM3, . . . which in turn drive the transistors Tr1, Tr2, Tr3, . . . .

The transistors Tr1, Tr2, Tr3, . . . have their emitters connected to a power supply $V_{DD}$ and the collectors connected to the protection resistors r1, r2, r3, . . . . The current flowing through the resistors r1, r2, r3, . . . flow through LEDs 38*a*, 37-1, 37-2, 37-3, . . . . The resistors r1, r2, r3, . . . are of the same resistance.

The amplifiers AM1, AM2, . . . are of the same construction and therefore only the AM1 will be described as an example.

Figure 5:
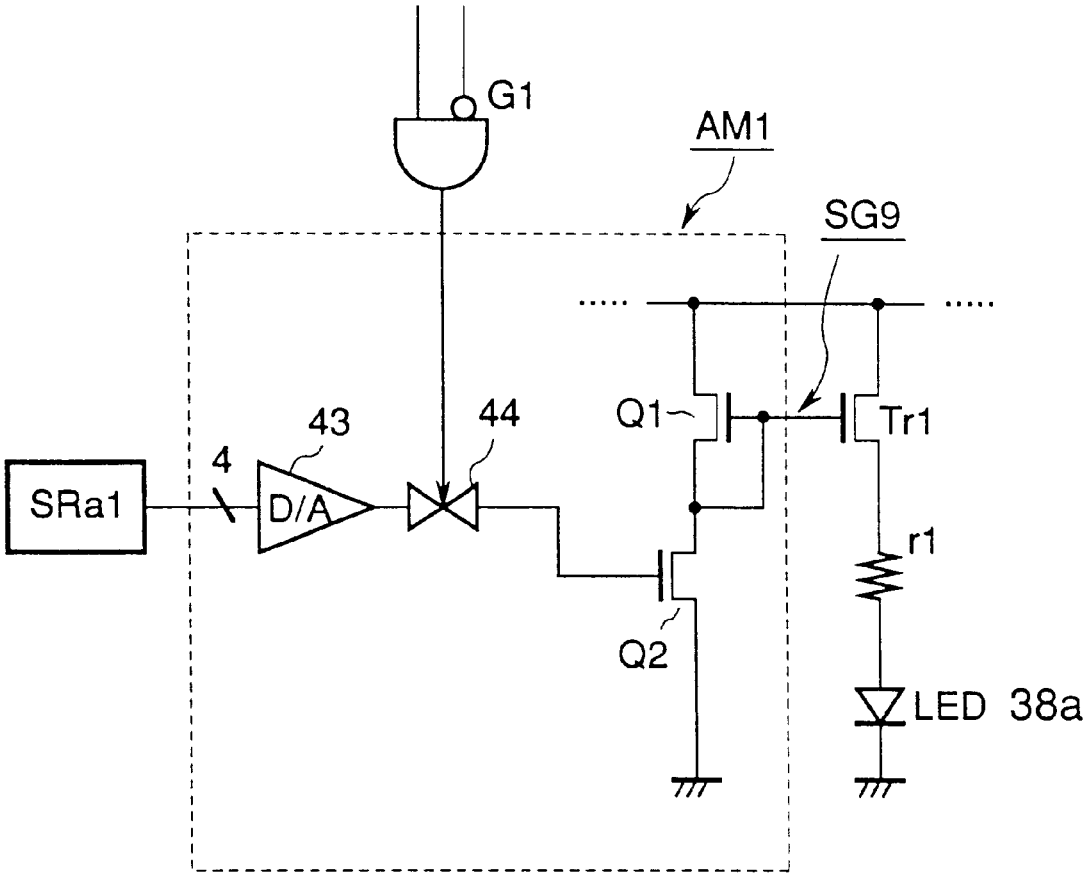
FIG. 5 is a schematic diagram showing the amplifier AM1.
Figure 6:
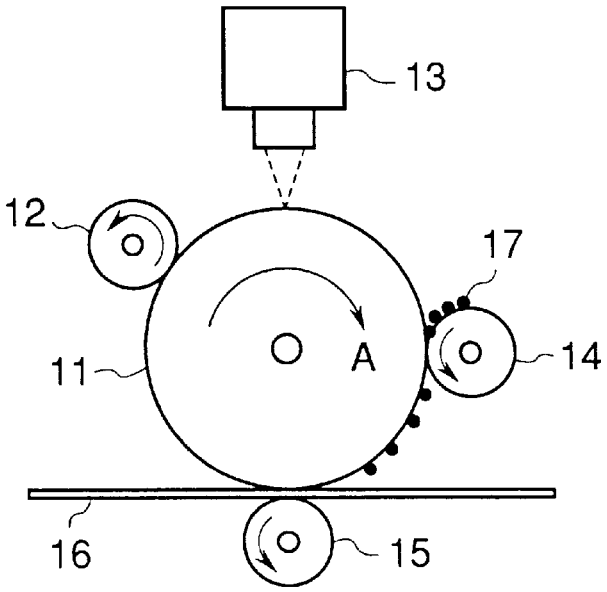
FIG.6 CONVENTIONAL ART
FIG. 6 illustrates a general construction of a conventional LED type electrophotographic printer.
Figure 7:
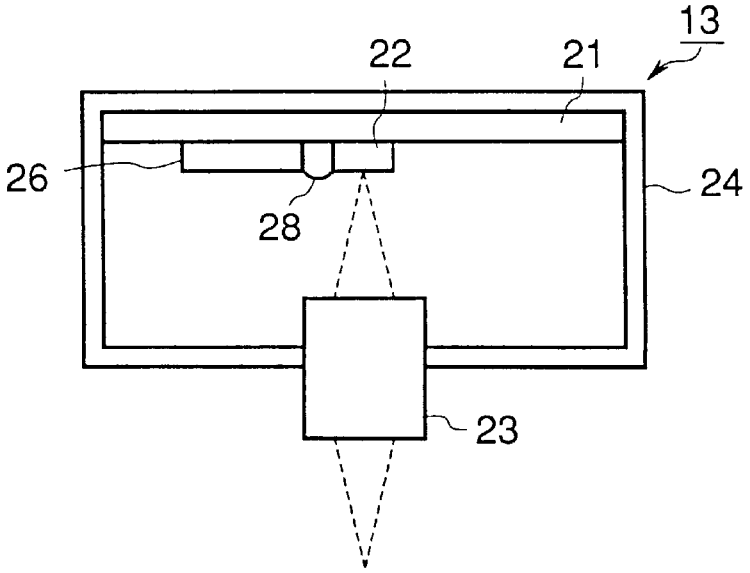
FIG.7 CONVENTIONAL ART
FIG. 7 illustrates a general construction of a conventional LED head shown in FIG. 6.
Figure 8:
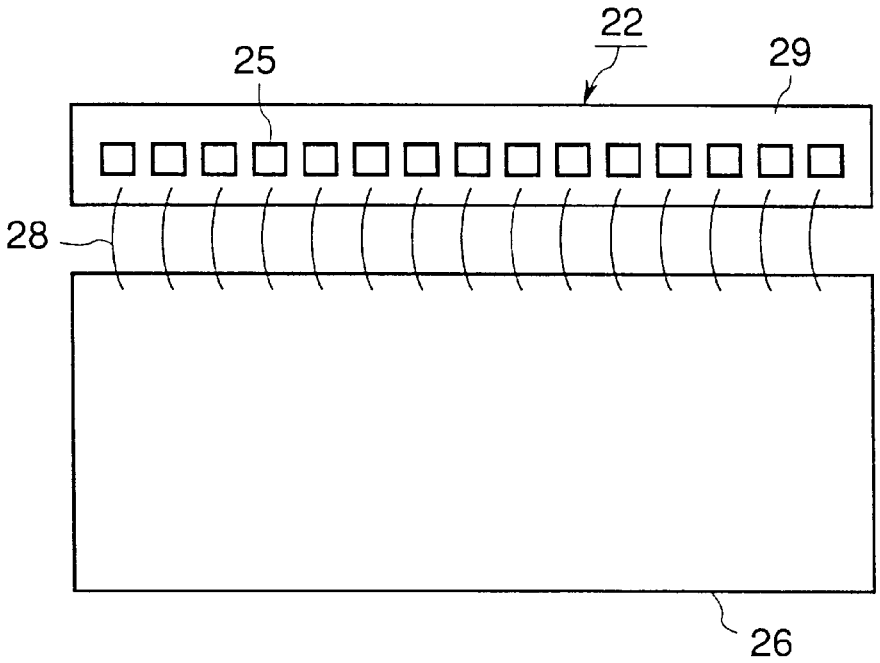
FIG.8 CONVENTIONAL ART
FIG. 8 illustrates the electrical wiring between the LED array and the LED driver shown in FIG. 7.
Figure 9:
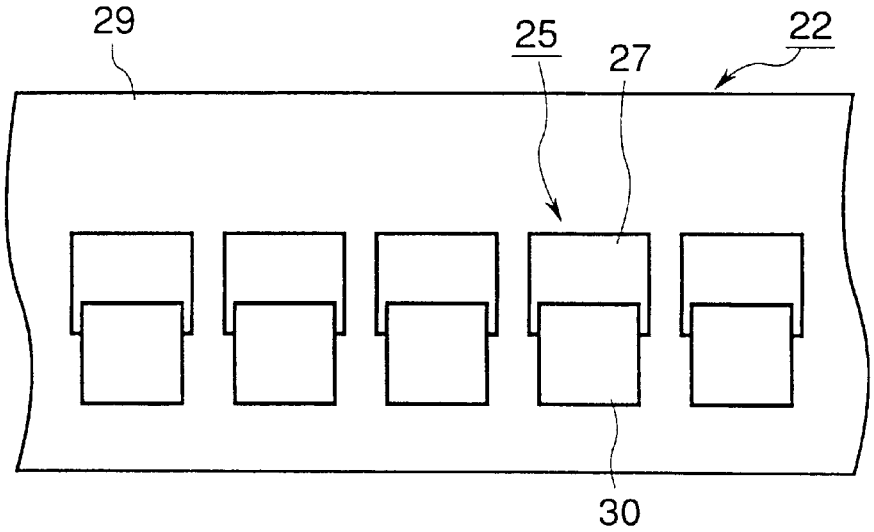
FIG.9 CONVENTIONAL ART
FIG. 9 illustrates the conventional LED array shown in FIG. 6.
Figure 10:
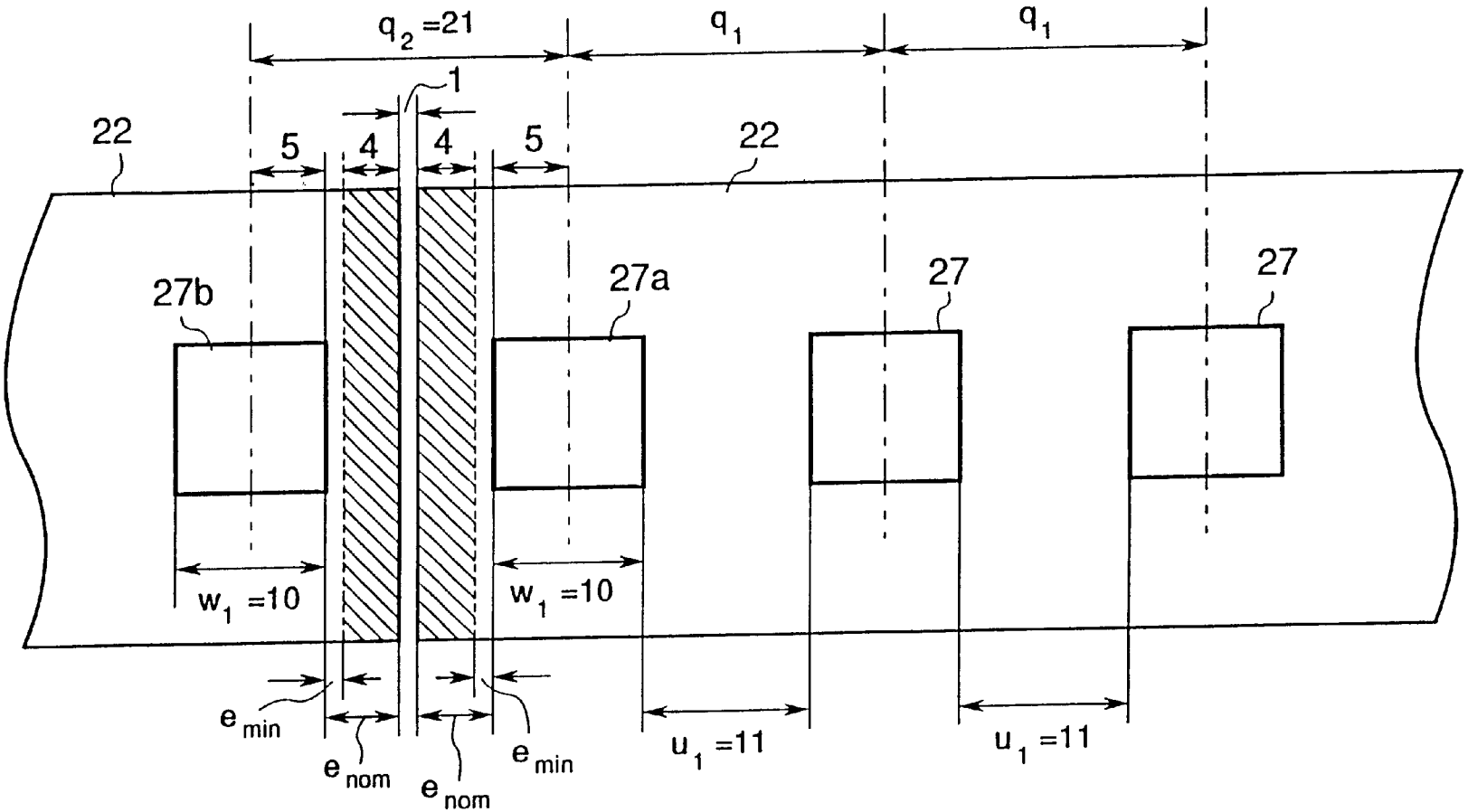
FIG.10 PRIOR ART
FIG. 10 illustrates the conventional LED array mounted side by side.

FIG. 5 is a schematic diagram showing the amplifier AM1.

Referring to FIG. 5, the amplifier AM1 includes a digital-to-analog (D/A) converter 43, an analog switch 44, and transistors Q1 and Q2. The D/A converter 43 receives a 4-bit current-value signal SG5 held in the shift register SRa1 and converts it into an analog voltage. The analog switch 44 is closed by the output of the gate G1 to pass the analog voltage. The output of the analog switch 44 is amplified by the transistors Q1 and Q2 into an adjusting signal SG9 which in turn is input to the base of the transistor Tr1.

In this manner, the LEDs 38*a*, 38*b*, and 37 of each LED array 32 are driven so that the LEDs 38*a* and 38*b* emit the same amount of light, as the LEDs 37. This operation prevents the dots formed by the LEDs 38*a* and 38*b* from becoming smaller than those formed by the LEDs 37 during the printing operation, thus preventing the print quality from being impaired. The components such as the transistors Q1, Q2, and Tr1 vary in electrical characteristics such as gain. Therefore, the current-value signals SG5 are determined by individually measuring the currents through the individual LEDs 38*a*, 38*b*, 37-1, 37-2, 37-3, . . . taking variations in the electrical characteristics of these components.

The LEDs 38*a* and 38*b* consume more electric current than the LEDs 37, increasing the total power dissipation of the LED array 32. However, such an increase in current is quite negligible since the number of the LEDs 38*a* and 38*b* in each LED array 32 is very small compared to that of the LEDs 37 in the same LED array 32.

In the present invention, the currents supplied to the LEDs 38*a* and 38*b* are larger than those supplied to LEDs 37 in order to provide the same amount of emitted light as the LEDs 37. Alternatively, the LEDs 38*a* and 38*b* may be supplied with the same current as the LEDs 37 but the current may be supplied for a longer time to the LED 38 than to the LEDs 37, thereby effectively supplying more electric energy to the LED 38 than to the LEDs 37.

The invention being thus described, it will be obvious that the same may be varied in many ways. Such variations are not to be regarded as a departure from the spirit and scope of the invention, and all such modifications as would be obvious to one skilled in the art are intended to be included within the cope of the following claims.

What is claimed is:

1. An LED head, comprising:

a circuit board; and a plurality of LED arrays aligned in a first direction on said circuit board, each of said plurality of LED arrays including a plurality of first LEDs, a second LED, and a third LED, aligned in the first direction, wherein said first LEDs are disposed between said second LED and said third LED and have a first dimension in the first direction, and said second LED and said third LED have a second dimension in the first direction, the second dimension being shorter than the first dimension.

2. The LED head according to claim 1, wherein said first LEDs, second LED, and third LED have a same third dimension in a direction perpendicular to the first direction.

3. The LED head according to claim 1, wherein each said second LED and said third LED of each of said LED arrays is disposed a predetermined minimum distance away from a respective end of said LED array in the first direction.

4. The LED head according to claim 3, wherein said predetermined minimum distance is about two microns.

5. The LED head according to claim 3, wherein for adjacent ones of said plurality of LED arrays, the second LED of a first adjacent LED array and the third LED of a second adjacent LED array are separated by a predetermined distance in the first direction.

6. The LED head according to claim 5, wherein a first distance in the first direction between the second LED of the first adjacent LED array and a nearest end of the first adjacent LED array, and a second distance in the first direction between the third LED of the second adjacent LED array and a nearest end of the second adjacent LED array, are selected so that the second LED of the first adjacent LED array and the third LED of the second adjacent LED array are separated by the predetermined distance.

7. The LED head according to claim 1, wherein said first LEDs, said second LED, and said third LED are aligned at predetermined intervals.

8. The LED head according to claim 7, wherein said plurality of LED arrays are aligned on said circuit board such that said first LEDs, said second LEDs, and said third LEDs of all of said LED arrays are aligned at the predetermined intervals.

9. The LED head according to claim 1, further including an LED driver which supplies electric energy to each of said first LEDs, said second LED, and said third LED to cause each of said first LEDs, said second LED, and said third LED to emit light.

10. The LED head according to claim 9, wherein said LED driver supplies different amounts of said electric energy to said first LEDs, said second LED, and said third LED so as to reduce differences among amounts of light emitted from said first LEDs, said second LED, and said third LED.

11. The LED head according to claim 10, wherein said LED driver supplies more said electric energy to said second LED and said third LED than to each of said first LEDs.

12. A method of making an LED head, comprising the steps of:

forming a plurality of LED arrays aligned in a first direction on a semiconductor wafer, each LED array including a plurality of first LEDs, a second LED, and a third LED aligned in the first direction, wherein said first LEDs are disposed between said second LED and said third LED, said first LEDs having a first dimension in the first direction, and the second LED and said third LED having a second dimension in the first direction, the second dimension being shorter than the first dimension;

dicing the semiconductor wafer such that said plurality of LED arrays are separated into individual LED arrays; and assembling the individual LED arrays on a printed circuit board such that all of the first LEDs, second LEDs, and third LEDs of all of the LED arrays are aligned in the first direction.

* * * * *